US008635760B2

(12) United States Patent
Pflugmacher et al.

(10) Patent No.: US 8,635,760 B2
(45) Date of Patent: Jan. 28, 2014

(54) METHOD FOR PRODUCING A COMMUTATOR RING FOR AN ELECTRIC MACHINE

(75) Inventors: Olaf Pflugmacher, Giesen (DE); Christian Anders, Groβ Lobke (DE); Wolfgang Hecht, Nordstemmen (DE); Normen Sach, Langenhagen (DE)

(73) Assignee: Robert Bosch GmbH, Stuttgart (DE)

( * ) Notice: Subject to any disclaimer, the term of this patent is extended or adjusted under 35 U.S.C. 154(b) by 659 days.

(21) Appl. No.: 12/734,366

(22) PCT Filed: Oct. 28, 2008

(86) PCT No.: PCT/EP2008/064592

§ 371 (c)(1),
(2), (4) Date: Sep. 16, 2010

(87) PCT Pub. No.: WO2009/056537

PCT Pub. Date: May 7, 2009

(65) Prior Publication Data

US 2011/0043072 A1 Feb. 24, 2011

(30) Foreign Application Priority Data

Oct. 29, 2007 (DE) ..... 10 2007 051 583

(51) Int. Cl.
*H01R 43/06* (2006.01)

(52) U.S. Cl.
USPC ..... 29/597; 310/235

(58) Field of Classification Search
USPC ..... 29/596–597, 417, 732, 733; 310/233, 310/128, 135, 237, 431; 264/272.15
See application file for complete search history.

(56) References Cited

U.S. PATENT DOCUMENTS

| | | | | | |
|---|---|---|---|---|---|
| 3,492,519 | A * | 1/1970 | Boyer et al. | ..... | 310/235 |
| 4,868,440 | A * | 9/1989 | Gerlach et al. | ..... | 310/236 |
| 4,872,255 | A * | 10/1989 | Kogej et al. | ..... | 29/597 |
| 5,003,212 | A * | 3/1991 | Ibe et al. | ..... | 310/235 |
| 5,124,609 | A * | 6/1992 | Nagasaka | ..... | 310/233 |
| 5,204,574 | A * | 4/1993 | Kanno et al. | ..... | 310/233 |
| 5,491,373 | A * | 2/1996 | Cooper et al. | ..... | 310/235 |
| 5,637,944 | A * | 6/1997 | Shimoyama | ..... | 310/237 |
| 6,101,701 | A * | 8/2000 | Potocnik et al. | ..... | 29/417 |
| 6,157,108 | A * | 12/2000 | Potocnik et al. | ..... | 310/235 |
| 6,161,275 | A * | 12/2000 | Moss et al. | ..... | 29/597 |
| 6,643,912 | B1 * | 11/2003 | Behrens et al. | ..... | 29/597 |
| 6,958,563 | B2 * | 10/2005 | Hockaday et al. | ..... | 310/233 |

FOREIGN PATENT DOCUMENTS

| | | | | |
|---|---|---|---|---|
| CN | 1152811 | | 6/1997 | |
| DE | 195 43 998 | | 5/1997 | |
| DE | 197 43 086 | | 4/1999 | |
| DE | 103 19 460 | | 11/2004 | |
| EP | 000350855 | * | 1/1990 | ..... 29/597 |

(Continued)

*Primary Examiner* — Minh Trinh
(74) *Attorney, Agent, or Firm* — Kenyon & Kenyon LLP

(57) ABSTRACT

In a method for producing a commutator ring for a commutator of an electric machine, the lamellae of a commutator ring are formed of an electrically conductive, deformable band material, and they have at least one recess running in the longitudinal direction of the band material, before a desired number of the formed lamellae are closed to form the commutator ring. After the closing of the lamellae to form the commutator ring, a reinforcing ring made of an electrically nonconductive, deformation-resistant material is introduced into the recess and is fixed in the recess by plastic deformation of the lamellae of the commutator ring.

7 Claims, 4 Drawing Sheets

(56) References Cited

FOREIGN PATENT DOCUMENTS

| | | |
|---|---|---|
| GB | 2 307 599 | 5/1997 |
| JP | 63-209449 | 8/1988 |
| JP | 2002-345212 | 11/2002 |
| JP | 2007-89347 | 4/2007 |
| WO | WO 95/22185 | 8/1995 |
| WO | WO 2004/098000 | 11/2004 |

* cited by examiner

METHOD FOR PRODUCING A COMMUTATOR RING FOR AN ELECTRIC MACHINE

BACKGROUND OF THE INVENTION

1. Field of the Invention

The present invention relates to a method for producing a commutator ring for a commutator of an electric machine, as well as an electric machine.

2. Description of Related Art

Methods of the type mentioned at the outset for producing so-called roll commutators are known from published German patent application documents DE 195 43 998 A1 and DE 197 43 086 A1. In this method, a previously stamped continuous loop provided with a desired profile and made of copper or another electrically conductive deformable material is notched transversely to its direction of motion, to form the lamellae that are connected by a small crosspiece to the adjacent lamellae, and, in the commutator from published German patent application document DE 195 43 998 A1, have a plurality of swallow-tail-shaped recesses running in the longitudinal direction of the tape. A desired number of lamellae is cut off from the continuous loop that was thus reformed, and is closed by rolling using a rolling tool to form a commutator ring.

Into the closed commutator ring a hollow cylindrical carrier is subsequently introduced in such a way that it is aligned coaxially to the commutator ring, and then the interspace between the inner circumference of the commutator ring and the outer circumference of the carrier has a free-flowing insulating compound poured into it, which fills the swallow tail-shaped recesses that encircle the inner circumference of the commutator ring and the axial notches between the lamellae, and hardens after being poured, to produce a reliable, form locking connection between the carrier and the commutator ring, and to insulate electrically the adjacent lamellae at the contact surface of the carbon brushes from one another.

Since the electric machine equipped with the commutator is able to rotate in operation at a speed of up to 30,000 revolutions per minute, the commutator ring is subject to strong centrifugal forces which, barring suitable countermeasures, could lead to an undesired deformation of the metallic commutator ring, and with that, possibly to increasing spark formation between the carbon brushes and the commutator. To counter this, it is already known, among other things, from published German patent application document DE 103 19 460 A1, that one may provide the end faces of the lamellae with groove-like recesses, which are reached through by a prestressable ring armature, which holds each individual lamella radially inwards towards the carrier of the commutator ring in a prestressed manner. Because of this, at least the end faces of the commutator lamellae are prevented from detaching radially outwards from the carrier or from the insulating compound, at high operating speeds of the commutator. However, in order to avoid imbalances, the ring armature should be developed to be rotationally symmetrical, which makes the construction of prestressable ring armatures from high-tensile, nonelastic materials considerably more difficult. In addition, the processing and mounting of prestressable ring armatures in the commutator ring is also relatively costly.

BRIEF SUMMARY OF THE INVENTION

An object of the present invention is improving a method of the type mentioned at the outset to the extent that reinforcing the commutator ring of roll commutators is simplified, and providing an electric machine of the type mentioned at the outset, having a reinforced commutator ring that is easy to produce and to mount.

With respect to the method, the object is attained according to the present invention in that, after the closing of the lamellae, a reinforcing ring made of an electrically nonconductive material, that is resistant to deformation, is introduced into the recess and fixed in the recess by plastic deformation of the lamellae of the closed commutator ring.

By these measures, on the one hand, the reinforcing ring may be made of any suitable material and produced in any suitable shape. On the other hand, the reinforcing ring is secured in the recess by the deformation of the commutator ring, so that it is protected from accidental loss during additional processing procedures. In addition, in this way the temperature resistance and the resistance to centrifugal forces of the finished commutator is able to be improved and, because of the deformation of the commutator ring, a costly prestressing of the reinforcing ring may be omitted.

With regard to the electric machine, the object is attained in that at least one part of the lamellae bordering the recess for fixing the reinforcing ring is plastically deformed, so that, in that location, the lamellae are pressed against the reinforcing ring.

The recess in the lamellae is preferably open in the axial direction of the closed commutator ring, so that the reinforcing ring is able to be introduced into the recess in this direction. After the deformation of the commutator ring, the recess may remain open in the axial direction, but it may also be closed by the hardened molding compound or insulating compound which connects the commutator ring in the finished commutator to its carrier. In this case, the molding compound or the insulating compound penetrates not only into the interspaces between the lamellae but also into the recess, whereby the reinforcing ring is additionally secured in the recess.

In the location where the lamellae of the commutator ring have a single recess for a reinforcing ring, this recess is expediently situated in the vicinity of an armature bearing. However, the lamellae may also have two recesses, which are situated at the opposite end faces of the commutator ring in such a way that a reinforcing ring is able to be fixed in each recess.

The fixing of the reinforcing ring in the recess under plastic deformation of the lamellae of the commutator ring preferably takes place by the crimping of at least one edge region of the recess, but the reinforcing ring may also be fixed in the recess in that a boundary edge of the recess, at closed commutator ring, is bent inwards, in the direction of the rotational axis of the commutator, and is pressed from the inside against an opposite inner peripheral area of the reinforcing ring by passing a mandrel through the opening enclosed by the commutator ring.

It is basically also possible to fix the reinforcing ring in a recess of the lamellae which opens out in the radial direction into the peripheral area of the commutator ring that is used as the contact surface for the carbon brushes. However, this design approach is less favorable than a recess that is open in the axial direction, since a reinforcing ring closed in the circumferential direction is able to be introduced only into a recess that is open in the axial direction, which then has to be closed by the deformation of the commutator ring at the open side, which requires a greater deformation of the lamellae.

The reinforcing ring is preferably made of a fiber-reinforced resin or plastic material, so that it may be produced easily and economically.

DETAILED DESCRIPTION OF THE INVENTION

Figure 1:
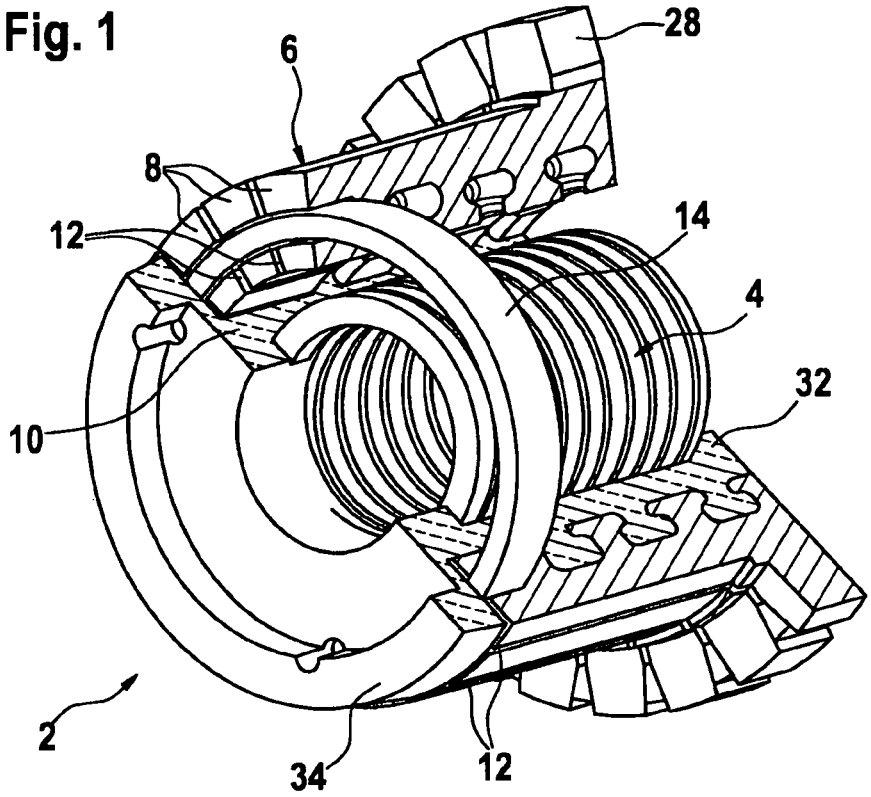
FIG. 1 shows a partially cut away perspective view of a so-called roll commutator for an electric machine.
Figure 2:
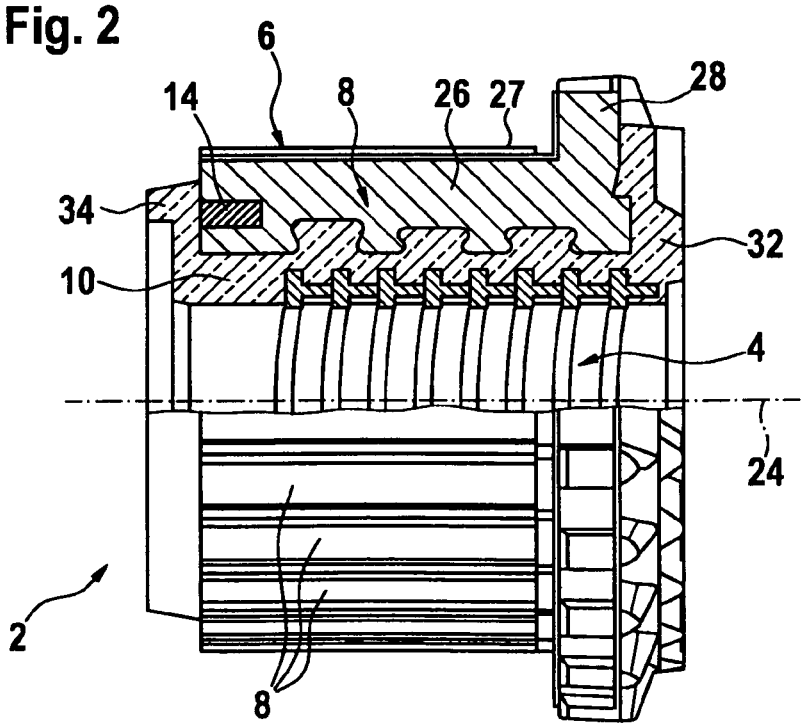
FIG. 2 shows a partially cut away view of the commutator.
Figure 8:
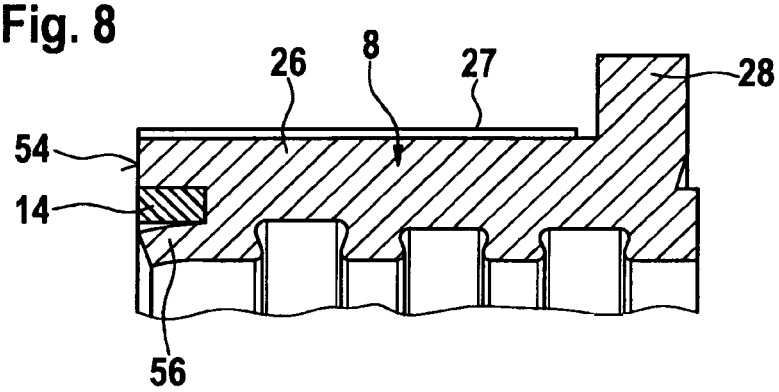
FIG. 8 shows a sectional view of the commutator ring after the introduction of the reinforcing ring into the groove along the line VIII-VIII of FIG. 6.
Figure 11:
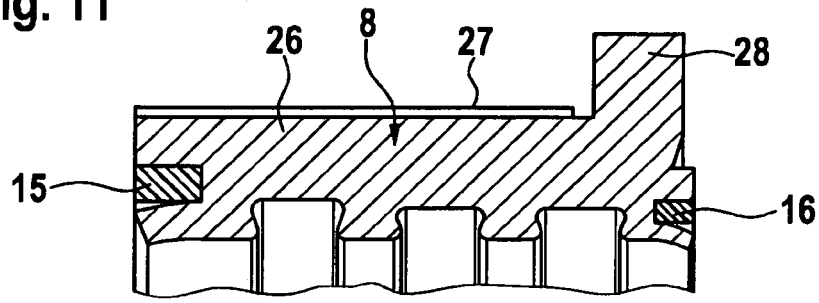
FIG. 11 shows a view of the commutator ring of FIG. 10, corresponding to FIG. 8.

Hollow commutator 2 of an electric machine, shown in FIGS. 1 and 2, is destined for mounting on a rotor shaft of a rotor of the electric machine. Commutator 2 is made up essentially of a spirally wound, tube-shaped carrier 4 situated at its inner circumference, a metallic commutator ring 6, situated at the outer circumference of commutator 2, which includes a plurality of axial lamellae 8, as well as an insulating material or molding material 10 made of a hardened resin or plastic material 10, which connects commutator ring 6 to the carrier 4 in a form locking manner, and fills the gaps 12 between each adjacent lamellae 8 of commutator ring 6. Commutator 2 also includes a reinforcing ring 14 (FIGS. 1, 8 and 9) or two reinforcing rings 15, 16 (FIGS. 11 and 12), which are each situated in an associated, essentially annular, accommodation groove 18 or 20 and 22 of lamellae 8 of commutator ring 6. Reinforcing rings 14, 15, 16 prevent commutator ring 6 from deforming or detaching from carrier 4 as a result of the centrifugal forces occurring during operation at high rotational speeds.

As seen in longitudinal section of commutator 2, lamellae 8 of commutator ring 6 have an L-shaped profile, as is shown best in FIGS. 2 and 7 to 12. A longer leg 26, that is parallel to rotational axis 24 of commutator 2, on its outer side 21 forms the counter-contact for the carbon brushes sliding on the periphery of commutator 2, while a shorter leg 28 that radially projects beyond at an end face of longer leg 26 is used as a winding terminal, which is connected to the rotor windings after the mounting of commutator 2 on the rotor shaft. At its inner circumference, commutator ring 6 has three fastening grooves 30 that are left open as approximately swallow tail shapes, which fill up with the free-flowing insulating or molding material 10, just as do gaps 12 between lamellae 8, during the mounting of commutator ring 6 on carrier 4.

At the two opposite end faces of commutator 2, insulating or molding material 10 forms a shoulder 32 and 34 respectively, which overlaps a part of the adjacent end faces of lamellae 8 of commutator ring 6, and closes accommodating groove 18 or accommodating grooves 20 and 22.

Reinforcing ring 14 or the two reinforcing rings 15 and 16 are made up of a plastic or resin material reinforced using glass fiber, carbon fiber or aramide fiber, and each has a rectangular cross section.

Figure 3:
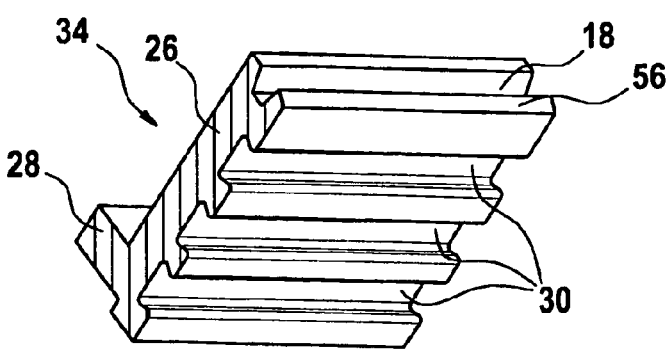
FIG. 3 shows a perspective view of a section of a profiled metallic band material, that is used for processing a commutator ring of a commutator.

For the production of commutator ring 6, a profiled band material 34 made of copper or another deformable, electrically conductive metal is used, of which a section is shown in FIG. 3. The cross section of the profiled band material 34 essentially corresponds to the cross section of lamellae 8, but with the difference that accommodation groove 18 used for accommodating reinforcing ring 14 and accommodations grooves 20, 22 used for accommodating reinforcing rings 15, 16 broaden out in the direction of the adjacent end face of lamellae 8, and have a somewhat larger groove cross section in comparison to the cross section of associated reinforcing rings 14, 15, 16. At least one of the two opposite boundary edges of accommodating groove 18 or 20 and 22 especially diverges in the direction of the adjacent end face.

Figure 4:
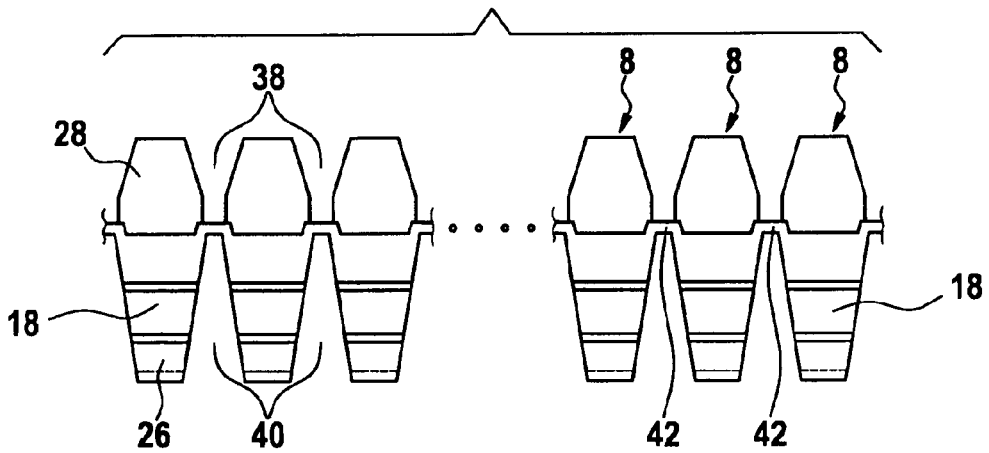
FIG. 4 shows an end face view of a section of the band material after the forming of lamellae of the commutator ring.

In a further method step, a plurality of parallel notches 38, 40 (FIG. 4) that run transversely to the longitudinal direction of the band material, are formed into the opposite sides of band material 34, whereby there comes about, when observing the end face of band material 34 in FIG. 3, that is equipped with accommodating groove 18, the cross section shown in FIG. 4, having a plurality of parallel lamellae 8, which are in each case separated from the two adjacent lamellae 8 by an upper and a lower notch 38 or 40, and are connected in each case to these lamellae 8 by a thin crosspiece 42.

In a subsequent method step, a predetermined number of lamellae 8 is cut off from band material 34 that is notched transversely to the longitudinal direction, by cutting through band material 34 along one of crosspieces 42.

In a further method step, lamellae 8 that are cut off are subsequently formed, using a rolling tool to form a closed commutator ring 6, as shown in a cutout in FIG. 5, lower notches between longer legs 26 closing except for narrow gaps, while upper notches 38 between shorter legs 28 become wider.

Figure 5:
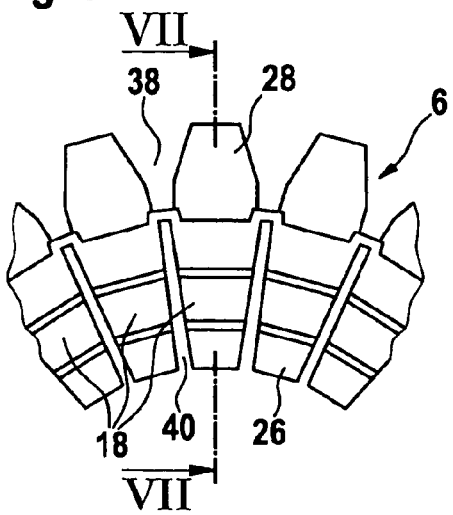
FIG. 5 shows an end face view of a section of the band material after the closing of the lamellae to form the commutator ring.

In this method step, each of accommodation grooves 18, 20, 22 that, before, ran in a straight line through one or both end faces of longer leg 26, becomes a polygonally shaped accommodation groove 18, 20, 22, as shown in FIG. 5, using the example of accommodation groove 18.

Figure 6:
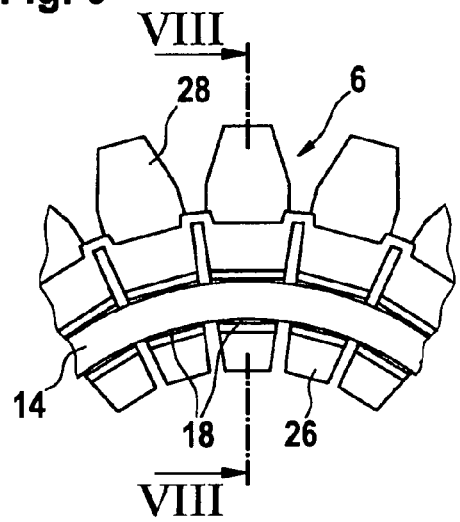
FIG. 6 shows an end face view corresponding to FIG. 5, however, after the introduction of a reinforcing ring into a groove left open in the lamellae.
Figure 7:
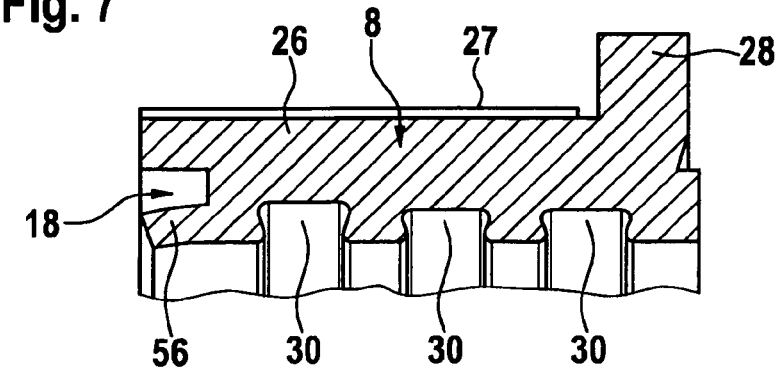
FIG. 7 shows a sectional view of the commutator ring along line VII-VII of FIG. 5.

As shown in FIG. 6 in the example of accommodation groove 18, in the next method step, the appertaining reinforcing ring 14 or 15, 16 is introduced in the axial direction into each of these accommodation grooves 18, 20, 22 that are open in the axial direction and open out into the adjacent end face of commutator ring 6.

Figure 12:
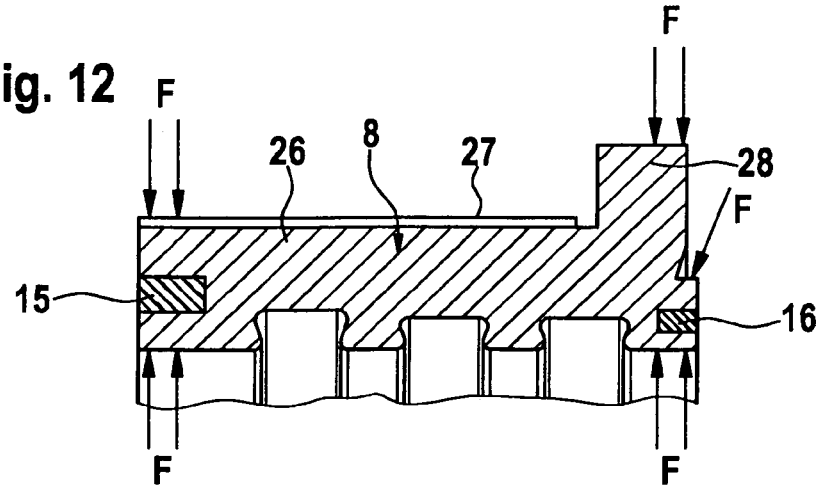
FIG. 12 shows a view of the commutator ring of FIG. 10, corresponding to FIG. 9.

In the following method step, reinforcing ring 14 or 15, 16 is fixed into the appertaining accommodation groove 18 or 20, 22 under plastic deformation of the commutator ring. To do this, the respectively adjacent end face of commutator ring 6 is compressed under plastic deformation by a compression force F that is applied in the radial direction from the inside and the outside onto the inner and outer periphery of lamellae 8, as shown in FIG. 9 or 12, in order firmly to clamp reinforcing ring 14 or 15, 16 into the appertaining accommodation groove 18 or 20, 22, so that the opposite inner and outer boundary edges of groove 18, 20, 22 are pressed against the inner or outer peripheral area of reinforcing ring 14; 15, 16, in the area of lamellae 8.

Figure 9:
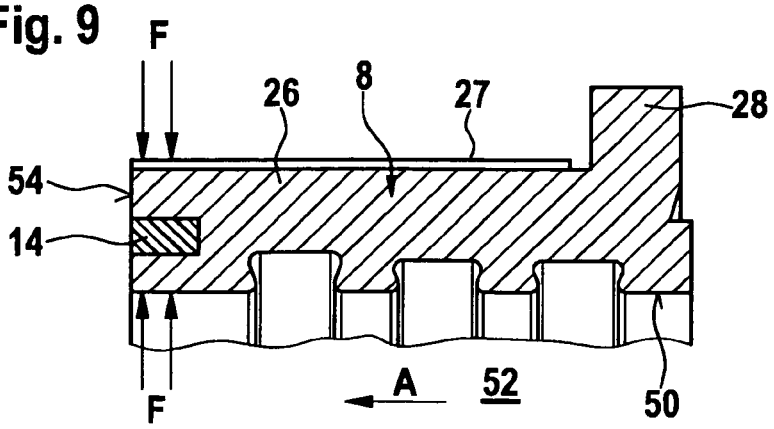
FIG. 9 shows a view corresponding to FIG. 8, but after the fixing of the reinforcing ring in the groove under plastic deformation of the commutator ring.
Figure 10:
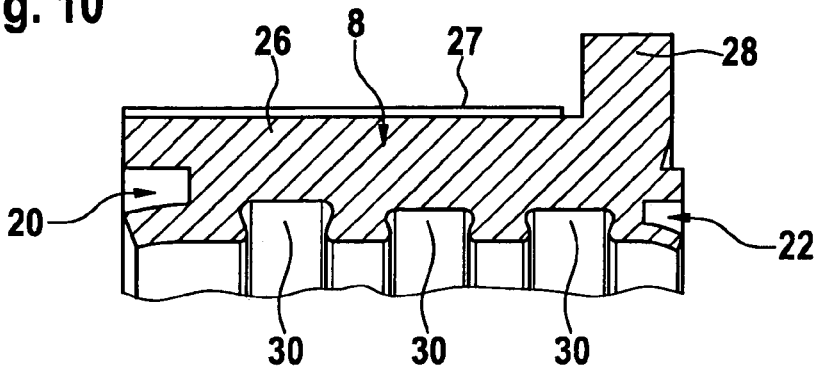
FIG. 10 shows a sectional view corresponding to FIG. 7, but of a commutator ring having two reinforcing rings.

In commutator ring 6 shown in FIGS. 1 through 9, this may also take place, for instance, in that a cylindrical mandrel, having an outside diameter corresponding to the inside diameter of inner peripheral area 50 of commutator ring 6, and having a tapered front end face from which pressure is applied from the end face of commutator ring 6 that is equipped with shorter legs 28 or winding terminals, in the direction of arrow A in FIG. 9 through hollow space 52 that is enclosed by commutator ring 6, in order to press an inner boundary edge 56 of groove 18, which previously diverged toward end face 54, in the area of lamellae 8, towards the outside against the inner peripheral area of reinforcing ring 14.

In both cases, an hollow-cylinder counter-support (not shown), that surrounds the periphery of commutator ring 6, prevents an excessive opening out of the end faces of lamellae 8.

What is claimed is:

1. A method for producing a commutator ring for a commutator of an electric machine, comprising:

forming lamellae of the commutator ring from an electrically conductive deformable band material, wherein the lamellae have at least one recess extending in the longitudinal direction of the band material;

closing in a tubular form a selected number of formed lamellae to form the commutator ring;

after the closing of the lamellae to form the commutator ring, introducing a reinforcing ring made of an electrically non-conductive, deformation-resistant material into the recess; and fixing the reinforcing ring in the recess by plastic deformation of the lamellae of the commutator ring.

2. The method as recited in claim 1, wherein the at least one recess in the lamellae is open in the axial direction of the commutator ring.

3. The method as recited in claim 2, wherein at least one recess for the reinforcing ring is situated in each end face of the commutator ring.

4. The method as recited in claim 2, wherein the reinforcing ring is fixed by the crimping of at least one edge region of the recess.

5. The method as recited in claim 2, wherein the reinforcing ring is fixed by widening out an opening enclosed by the commutator ring in the recess.

6. The method as recited in claim 2, wherein the reinforcing ring is made of one of a fiber-reinforced resin or plastic material.

7. The method as recited in claim 2, wherein the reinforcing ring has one of a rectangular or square cross section.

* * * * *

UNITED STATES PATENT AND TRADEMARK OFFICE

CERTIFICATE OF CORRECTION

PATENT NO. : 8,635,760 B2
APPLICATION NO. : 12/734366
DATED : January 28, 2014
INVENTOR(S) : Pflugmacher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 799 days.

Signed and Sealed this
Twenty-second Day of September, 2015

Michelle K. Lee

Michelle K. Lee
*Director of the United States Patent and Trademark Office*